US007945024B2

(12) United States Patent
Lemaitre

(10) Patent No.: US 7,945,024 B2
(45) Date of Patent: May 17, 2011

(54) METHOD FOR REDUCING X-RAY TUBE POWER DE-RATING DURING DYNAMIC FOCAL SPOT DEFLECTION

(75) Inventor: Sergio Lemaitre, Whitefish Bay, WI (US)

(73) Assignee: General Electric Company, Schenectady, NY (US)

( * ) Notice: Subject to any disclaimer, the term of this patent is extended or adjusted under 35 U.S.C. 154(b) by 268 days.

(21) Appl. No.: 11/465,110

(22) Filed: Aug. 16, 2006

(65) Prior Publication Data

US 2008/0043916 A1 Feb. 21, 2008

(51) Int. Cl.
*H01J 35/30* (2006.01)

(52) U.S. Cl. ..... 378/137; 378/138

(58) Field of Classification Search ..... 378/137–138
See application file for complete search history.

(56) References Cited

U.S. PATENT DOCUMENTS 4,631,742 A * 12/1986 Oliver ..... 378/113
6,778,633 B1 * 8/2004 Loxley et al. ..... 378/113
2005/0163281 A1 * 7/2005 Negle ..... 378/84

* cited by examiner

*Primary Examiner* — Hoon Song
(74) *Attorney, Agent, or Firm* — Bill Baxter, Esq.; Michael G. Smith, Esq.; Ellis Ramirez, Esq.

(57) ABSTRACT

Methods are provided through which X-ray tube power de-rating can be reduced during dynamic focal spot deflection. In one embodiment, a method comprising generating an electron beam, focusing the electron beam to a first position on an anode, defocusing the electron beam on the anode and refocusing the electron beam at a second position on the anode. In another embodiment, a method comprising generating an electron beam, focusing the electron beam to a first position on an anode, inhibiting the electron beam and refocusing the electron beam at a second position on the anode. In another embodiment, a method comprising generating an electron beam, focusing the electron beam to a first position on an anode, steering the electron beam away from a nominal focal spot radius on the anode and refocusing the electron beam at a second position on the anode.

17 Claims, 8 Drawing Sheets

500

METHOD FOR REDUCING X-RAY TUBE POWER DE-RATING DURING DYNAMIC FOCAL SPOT DEFLECTION

FIELD OF THE INVENTION

This invention relates generally to X-ray tubes, and more particularly to X-ray tubes used in computed tomography.

BACKGROUND OF THE INVENTION

Diagnostic imaging systems such as computed tomography (CT) demand high power and high resolution. Higher power X-ray tubes allows an imager to image denser materials with less exposure time and this can be extremely beneficial for injured patients who must remain stationary during the imaging process. Higher resolution imagers allows for greater detail in the object being imaged which can aid in patient diagnosis. Therefore, an X-ray tube that provides for both higher power and higher resolution is more desirable over lower powered lower resolution replacements.

Unfortunately, higher X-ray tube power increases the temperature of the X-ray tube's anode and this higher temperature can lead to X-ray tube failure unless mitigation techniques are utilized to reduce the heat before damage occurs. One method to reduce anode heating is by rotating the anode in the X-ray tube to spread the heat caused by the electron beam impacting the surface of the anode across the surface of the anode. By reducing the localized heating on the anode, higher X-ray tube powers can be achieved.

A common method to increase the resolution of imaging systems using digital detectors is by oversampling. To achieve oversampling, the focal spot is moved between two successive views on the anode using electrostatic or magnetostatic means. If the electron beam is deflected with or against the direction of the target anode, at the focal spot location, the deflection is referred to as x-wobble or x-deflection. Focal spot motion in the +x direction coincides with the direction of the target surface motion while focal spot motion in the −x direction is opposite to the direction of the target surface motion.

FIG. 1 is a perspective view of the components inside a typical X-ray tube that utilizes focal spot deflection. Typically, a high voltage power supply 102 supplies filament voltage 104 to filament 106 in an X-ray tube causing the filament 106 to heat up and boil off a stream of electrons 108. The electron beam 108 is drawn across the X-ray tube by the positively charged anode 110. The electron beam 108 impacts a small area on the target surface of the anode 110 called the focal spot. The interaction with the target material results in an X-ray beam.

Steering an electron beam using electrostatic mean is typically accomplished by arranging several electrodes 112, 116, 126, 128 in close proximity to the electron beam 108. Typically, the electrodes 112, 116 are energized to shape and deflect the electron beam 108 as the beam leaves the cathode 106 to two or more distinct locations 120, 122 on the anode depending on the bias applied to a particular electrode. In reference to FIG. 1, applying specific bias potentials to a first electrode 112 and a second electrode 116 will cause the electron beam 108 to move to distinct positions on anode 110. The magnitude of the beam movement is directly related to the magnitude of the bias applied to the electrodes. If the first bias voltage 114 on the first electrode 112 is greater than the second bias voltage 118 on the second electrode 116, electron beam 108 will move to the left or −x direction to a first focal spot position 120. Alternatively, if the bias voltage on the second electrode 116 is greater than the bias voltage on the first electrode 112, the beam will move to the right or the +x direction or to a second focal spot position 122. The magnitude of the electrode bias voltages and the position of the electrode with respect to the electron beam will determine the focal spot location.

Additionally, magnetostatic means can be used to steer the electron beam by placing magnets near the path of the electron beam. Varying the strength, polarity and position of the magnets with respect to the electron beam will determine the location of the focal spot on the anode if magnetostatic focal spot control is used.

FIG. 2 is a graph illustrating a heating and cooling cycle for a particular point in the focal spot on the anode when there is no focal spot deflection. When a particular location in a rotating anode tube enters the electron beam impacts region, the impact temperature at this location begins to rapidly increase. After this target location rotates out of the impact region with the electron beam or the electron beam is turned off, the localized temperature decreases as the location begins to cool.

When the anode is rotated to reduce anode heating and focal spot deflection to increase resolution are combined, creating an additional heating cycle is possible. If the focal spot is deflected in the same direction as the rotation of the anode 110, the +x direction, by simultaneously switching the bias voltage 114, 118, on the electrodes 112, 116, it is possible to cause increased anode heating shown in FIG. 3 if the transition time, anode rotation frequency, deflection distance and target radius are selected such that the relative speed between the target surface and the electron beam impact area is sufficiently small. The region on the target that is impacted by the electron beam is characterized by the area between the solid lines in FIG. 3. During the transition time $t_x$ the slope of the solid line equals the slope of the stitched lines. This represents the situation where the relative speed between the target surface and the electron beam impact area is zero. This represents a typical situation where the transition time is in the order of a few microseconds. Different transition times will influence the final anode temperature reached. However transition times much shorter than one microsecond are impractical due to design limitations of the voltage switching circuits, and much larger transition times are undesirable from an application standpoint due to loss of image information per unit time.

Point 302 on the anode 108 has a trajectory that remains within the impact area on the nominal focal spot radius 124 between the focal spot's static time $t_{S1}$ at a first position 120, through the transition $t_x$ and during the static time $t_{S2}$ at the second position 122. Without deflection the total time for any point on the target to remain under the electron beam would be $t_{S1}+t_{S2}$. The anode point 302 heats up as the impact area is bombarded at the first position 120 during $t_{S1}$, point 302 is then further heated during the transition period $t_x$ and finally point 302 is heated during heating cycle 304 at the second position 122 during the static time $t_{S2}$.

The additional heating cycle during the transition period $t_x$ for point 302 limits the maximum power the electron beam is allowed to carry and forces the user to decrease the X-ray tube's power such that the impact temperature remains below the X-ray tube manufacturer's maximum rated impact temperature of the X-ray tube. If the X-ray tube's power is not de-rated to prevent exceeding the maximum allowable operating temperature, the anode temperature may exceed the recommended maximum limits of the manufacture and damage to the anode can occur, leading to failure of the X-ray tube.

For the reasons stated above, and for other reasons stated below which will become apparent to those skilled in the art upon reading and understanding the present specification, there is a need in the art for a method for reducing X-ray tube power de-rating during dynamic focal spot deflection caused by anode heating.

BRIEF DESCRIPTION OF THE INVENTION

The above-mentioned shortcomings, disadvantages and problems are addressed herein, which will be understood by reading and studying the following specification.

The methods described below are suitable for reducing anode temperatures in X-ray tube systems using dynamic focal spot deflection with a rotating anode. By manipulating the electron beam focal spot during the transition period, anode temperature can be reduced allowing the user to achieve higher X-ray tube power.

In one aspect, a method is described for reducing X-ray tube power de-rating during dynamic focal spot deflection comprising generating an electron beam in a rotating anode X-ray tube, focusing the electron beam to a first position on an anode, defocusing the electron beam on the anode and refocusing the electron beam at a second position on the anode.

In another aspect, a method is described for reducing X-ray tube power de-rating during dynamic focal spot deflection comprising generating an electron beam in a rotating anode X-ray tube, focusing the electron beam to a first position on an anode, inhibiting the electron beam at least partially and refocusing the electron beam at a second position on the anode.

In yet another aspect, a method is described for reducing X-ray tube power de-rating during dynamic focal spot deflection comprising generating an electron beam in a rotating anode X-ray tube, focusing the electron beam to a first position on an anode, steering the electron beam away from a nominal focal spot radius on the anode and refocusing the electron beam at a second position on the anode.

Apparatus, systems, and methods of varying scope are described herein. In addition to the aspects and advantages described in this summary, further aspects and advantages will become apparent by reference to the drawings and by reading the detailed description that follows.

DETAILED DESCRIPTION OF THE INVENTION

In the following detailed description, reference is made to the accompanying drawings that form a part hereof, and in which is shown by way of illustration specific embodiments which may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken in a limiting sense.

Method Embodiments

Figure 1:
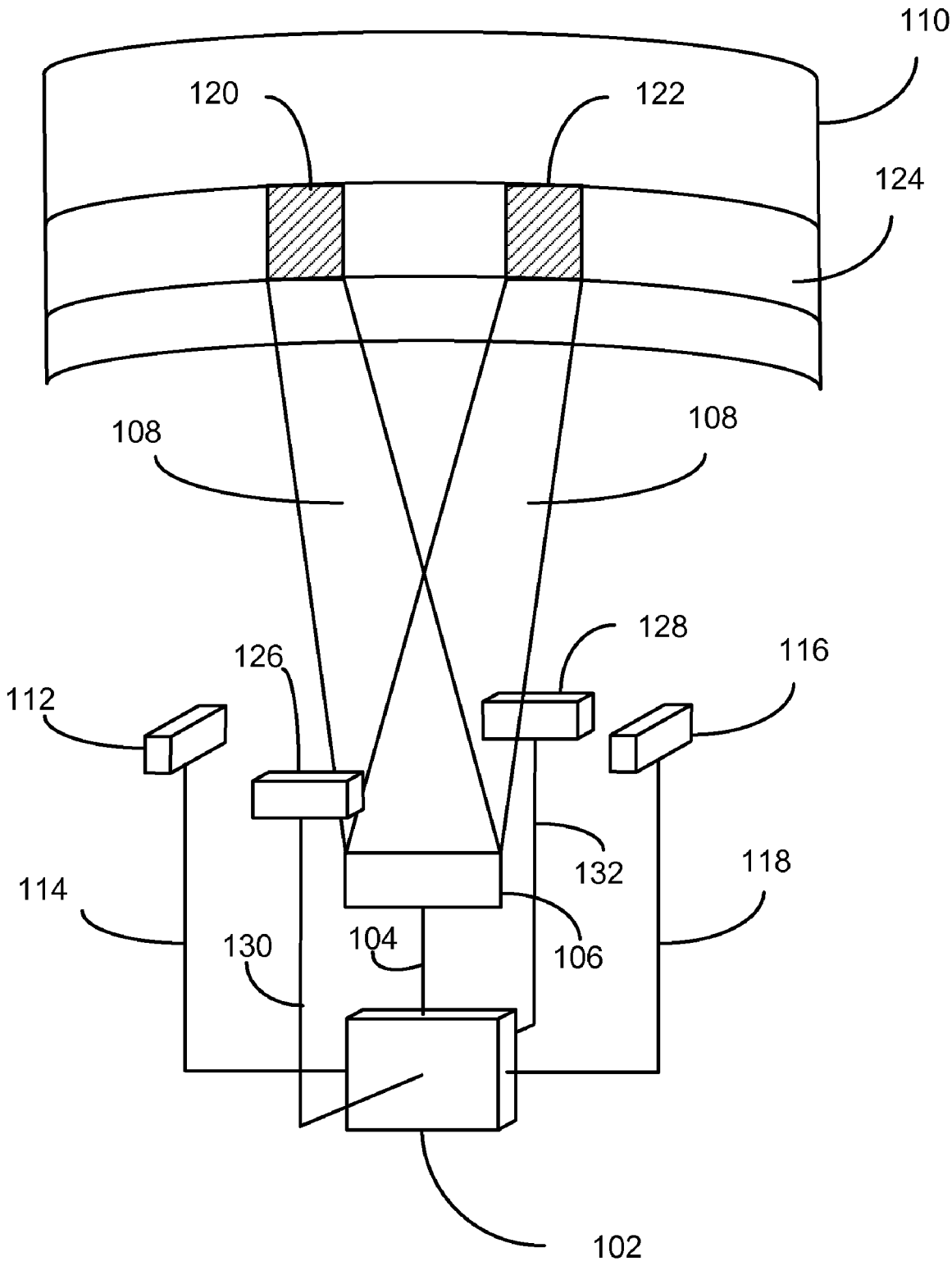
FIG. 1 is a perspective view of the components inside a typical X-ray tube that utilizes focal spot deflection.
Figure 2:
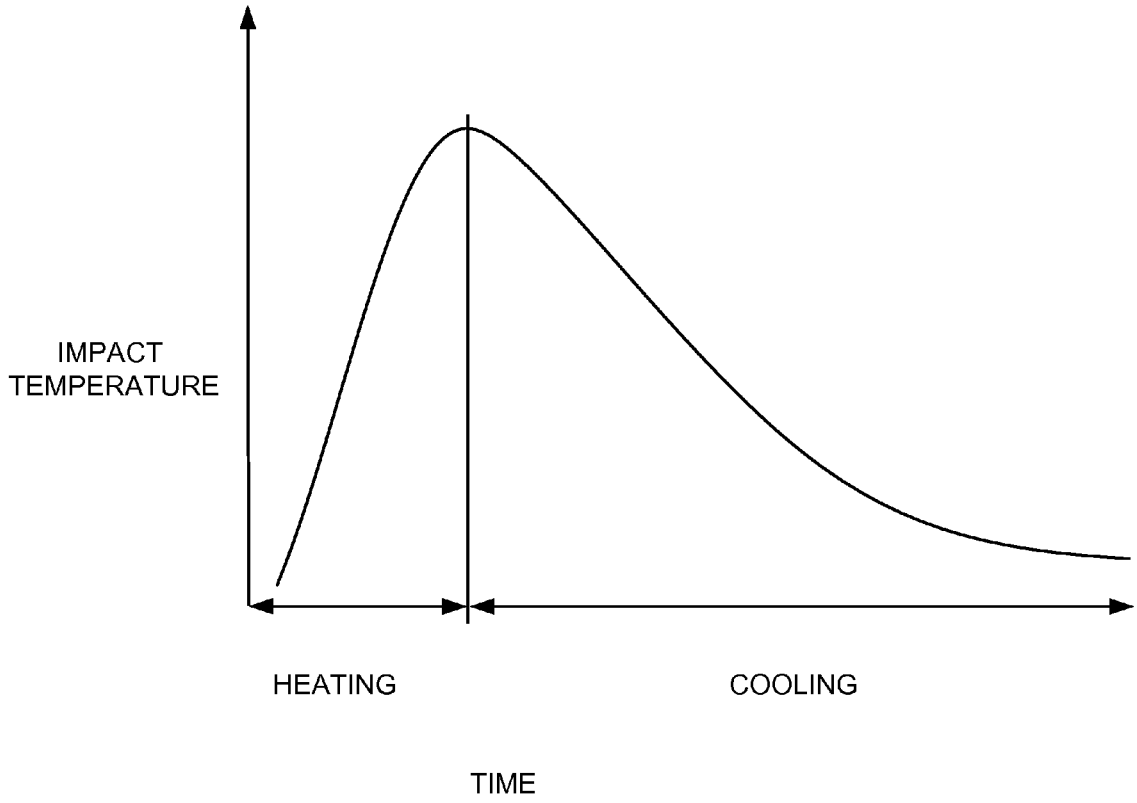
FIG. 2 is a graph illustrating a heating and cooling cycle for a particular point in the focal spot on the anode without focal spot deflection.
Figure 3:
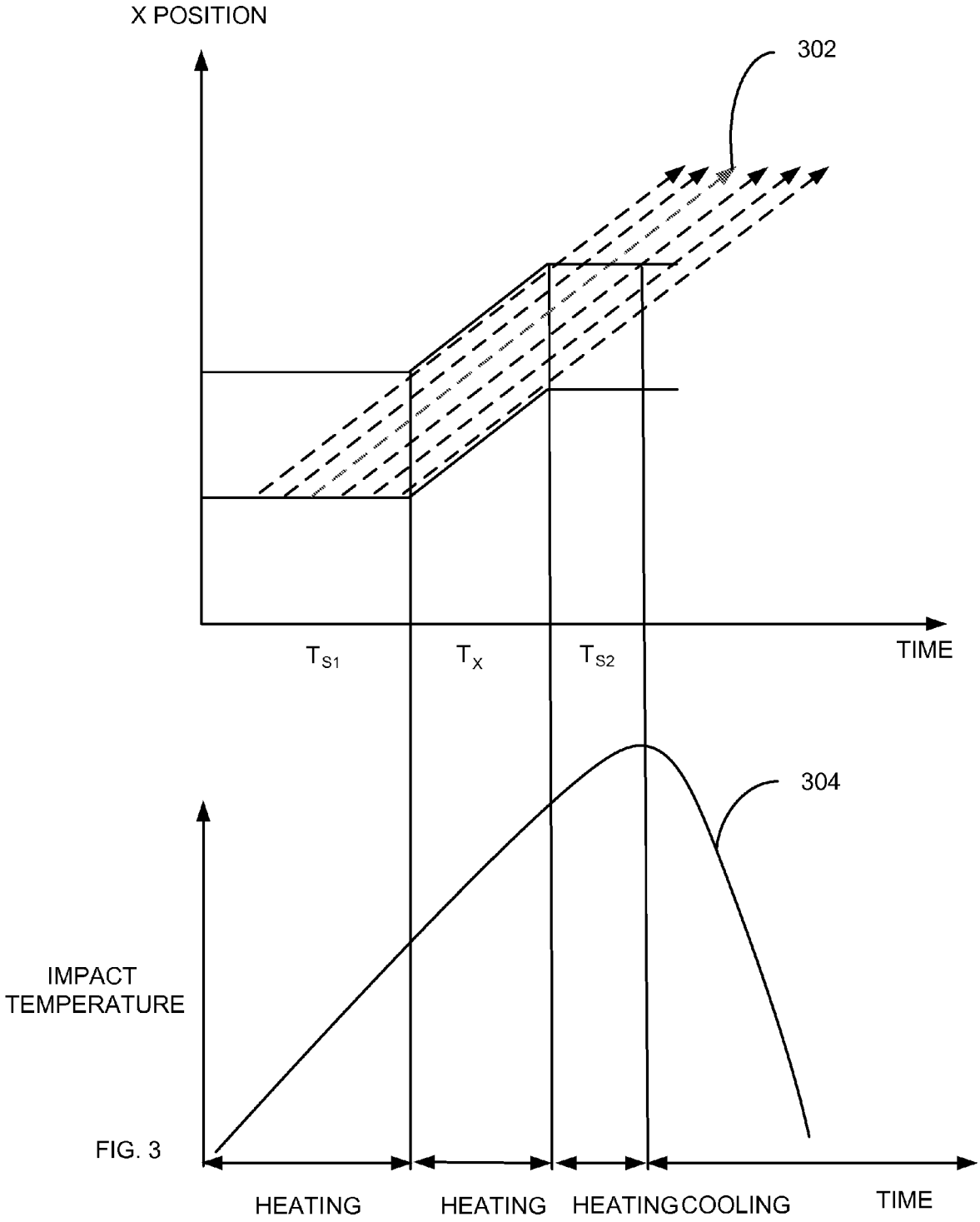
FIG. 3 is a graph illustrating a heating and cooling cycle for a particular point on a rotating anode X-tube with dynamic focal spot deflection where the transition time, anode rotation frequency, deflection distance and target radius are selected such that the relative speed between the target surface and the electron beam impact area is zero.
Figure 4:
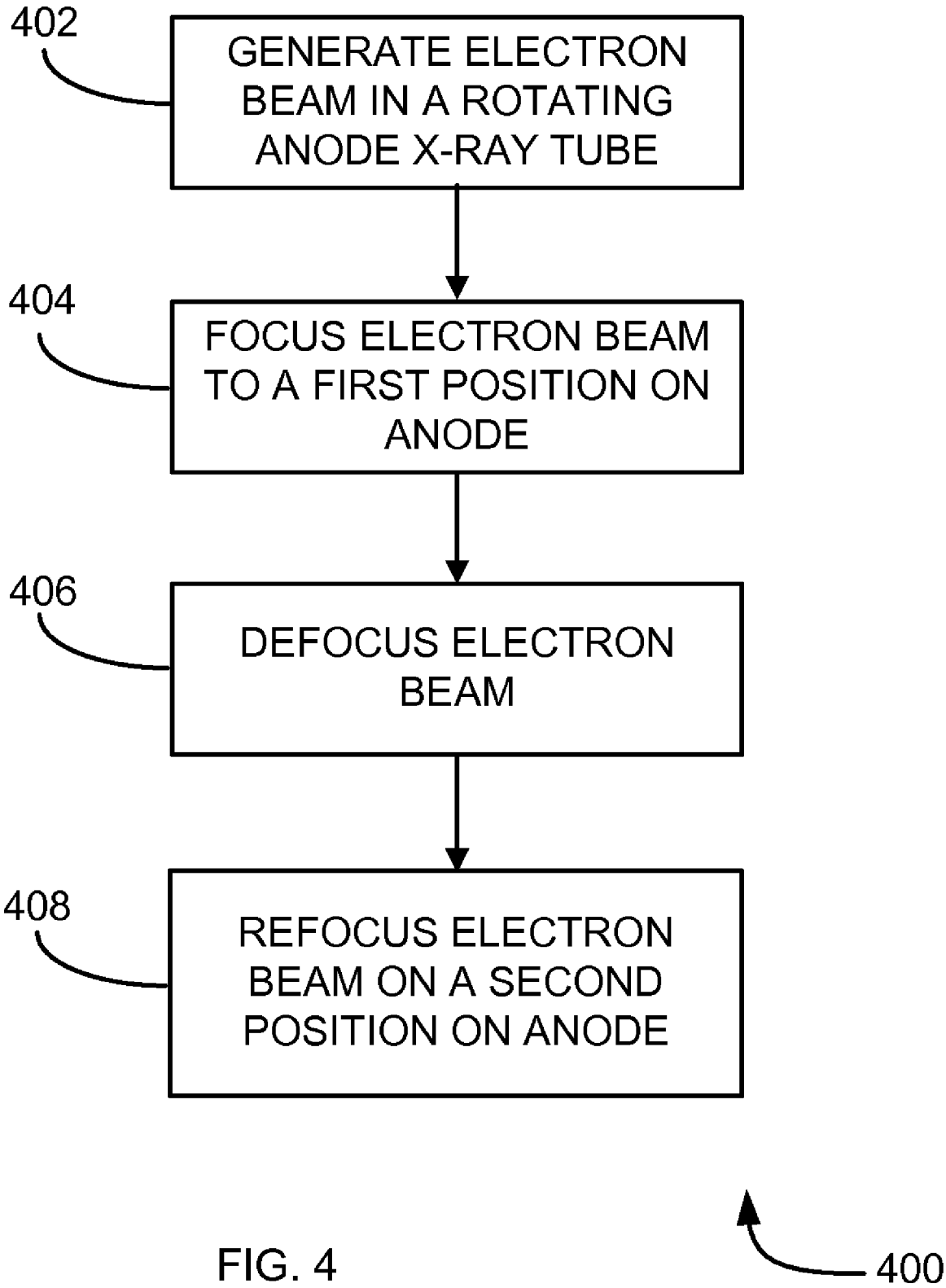
FIG. 4 is a flowchart of a method to reduce X-ray tube power de-rating during dynamic focal spot deflection according to an embodiment.

FIG. 4 is a flowchart of a method to reduce X-ray tube power de-rating during dynamic focal spot deflection according to an embodiment. Method 400 solves the need in the art to reduce X-ray tube power below manufacturer's limits to prevent overheating during oversampling.

In one embodiment, Method 400 includes generating an electron beam in a rotating anode X-ray tube 402, focusing the electron beam to a first position on an anode 404, defocusing the electron beam on the anode 406 and refocusing the electron beam at a second position on anode 408.

Figure 5:
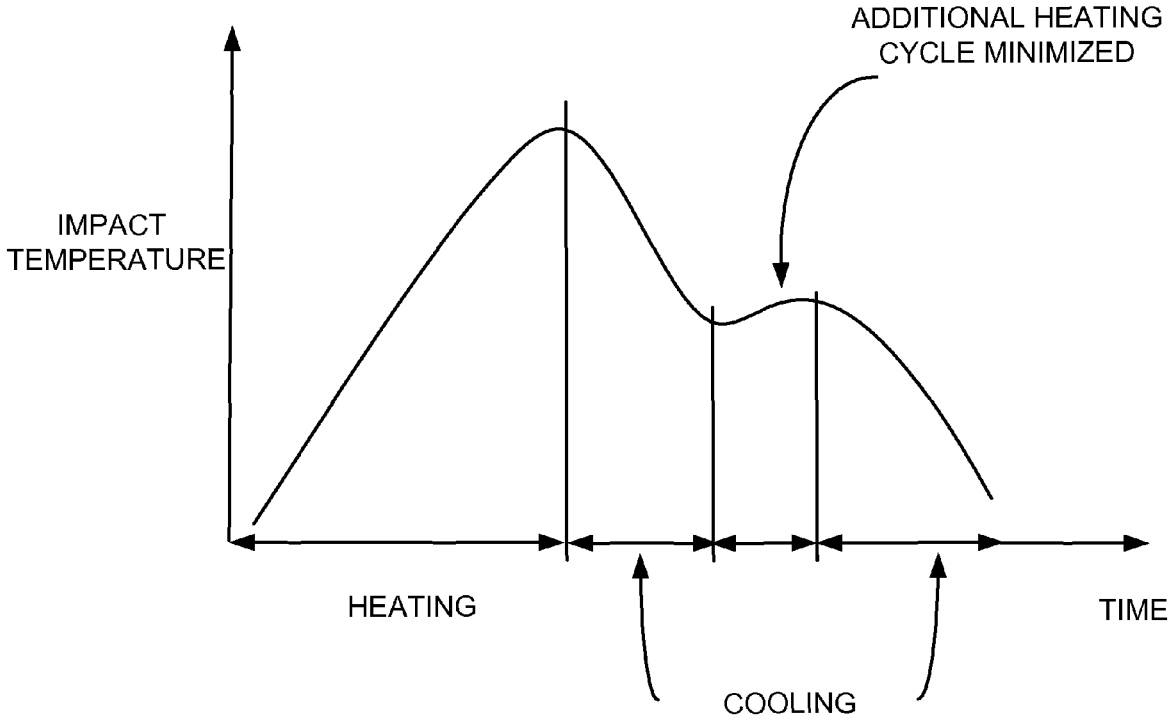
FIG. 5 is a graph illustrating a heating and cooling cycle for a particular point on a rotating anode X-ray tube with dynamic focal spot deflection where beam manipulation is used to reduce anode heating where the transition time, anode rotation frequency, deflection distance and target radius are selected such that the relative speed between the target surface and the electron beam impact area is zero.
Figure 6:
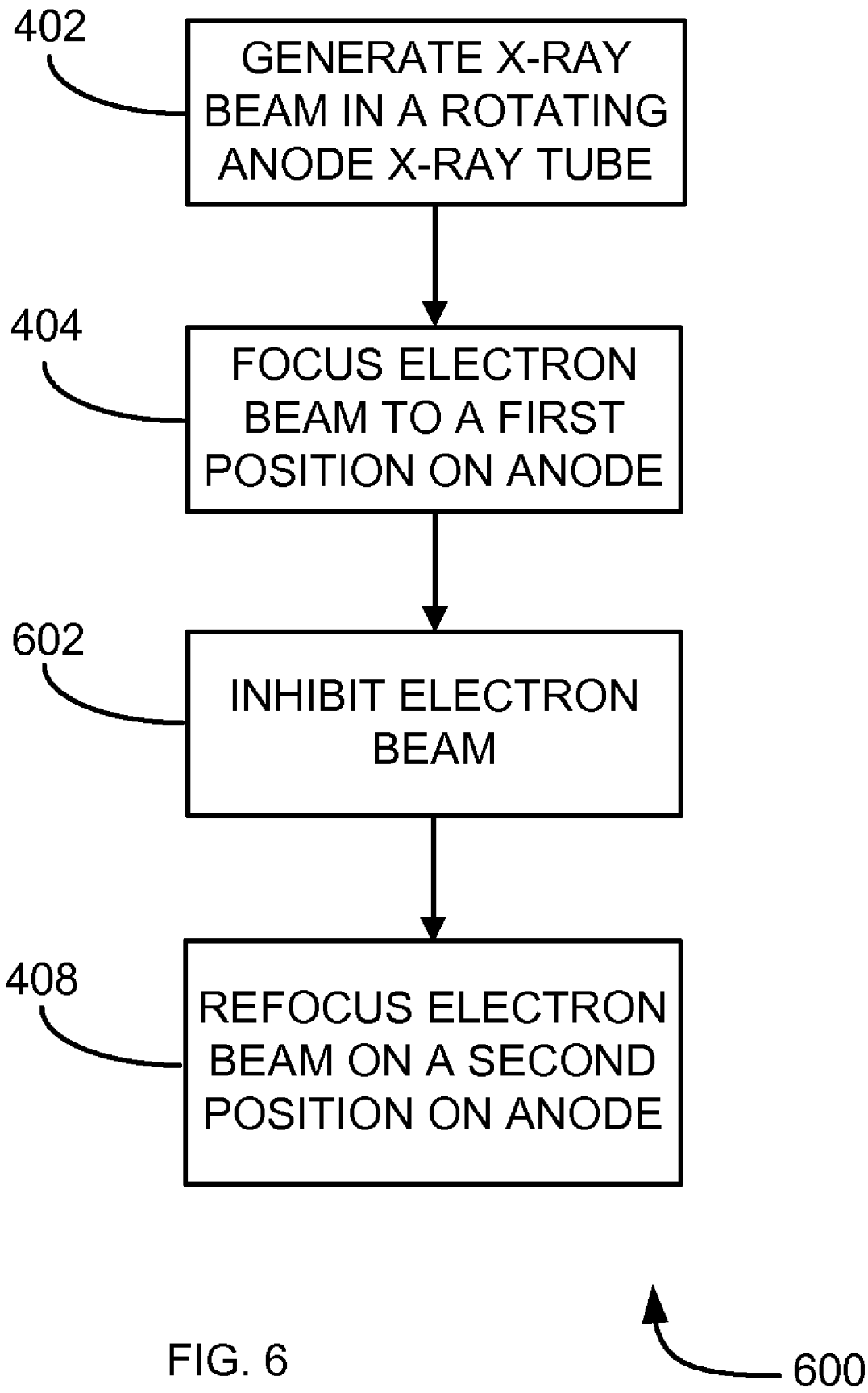
FIG. 6 is a flowchart of a method to reduce X-ray tube power de-rating during dynamic focal spot deflection according to an embodiment.
Figure 7:
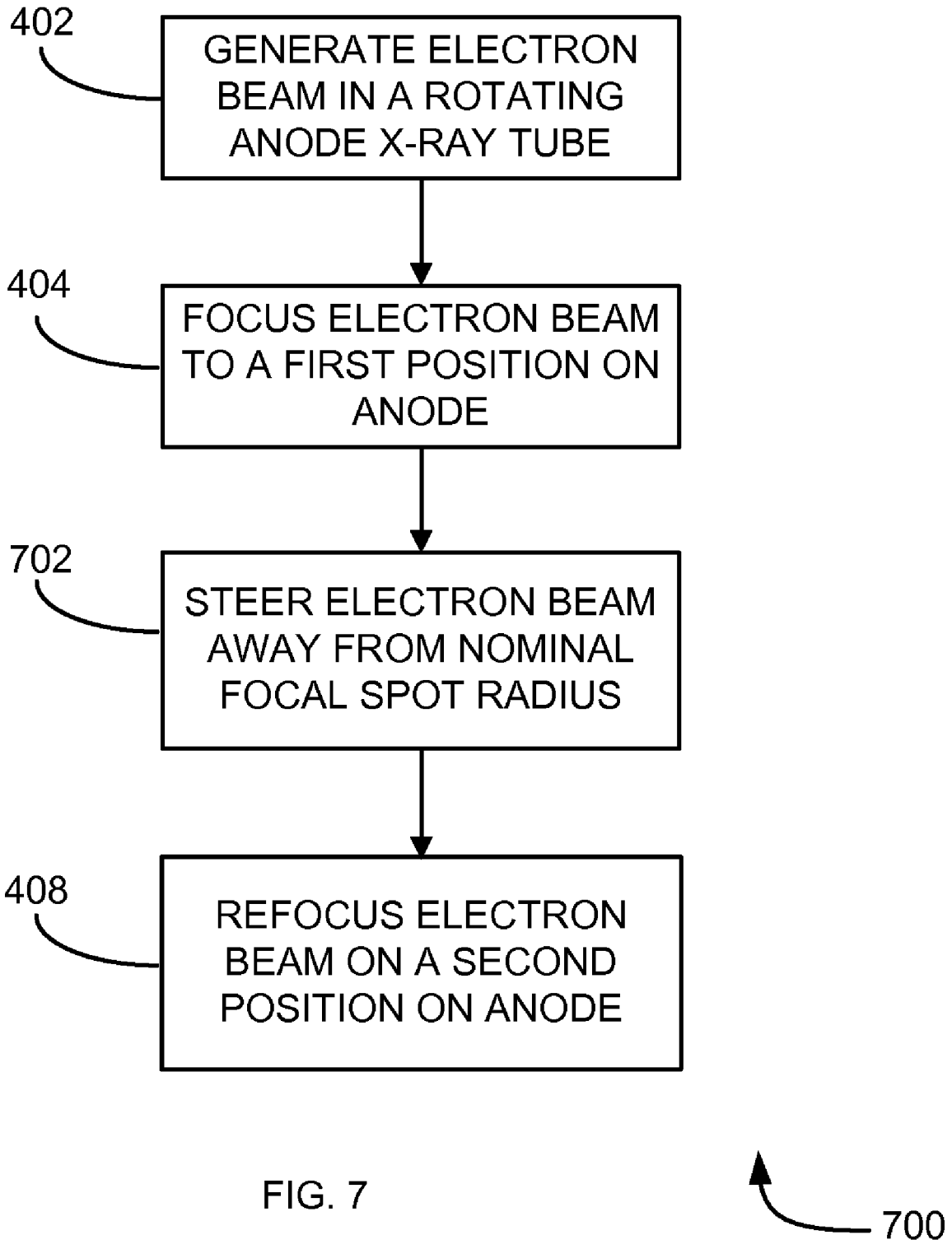
FIG. 7 is a flowchart of a method to reduce X-ray tube power de-rating during dynamic focal spot deflection according to an embodiment.

In reference to FIG. 5, when the electron beam 108 is focused to the first position 120, the impact area begins to heat up rapidly as shown. Prior to deflecting the electron beam 108 in the +x-direction to a second location 122, the electron beam 108 is defocused. The flux density of the defocused beam is reduced as the beam is spread out over a larger area. The impact temperature decreases as the flux density decreases. The electron beam is then refocused at the second position 122 on the anode 110 and the impact temperature begins to increase and peak a second time but total heating will be minimized because of the additional cooling obtained by defocusing the electron beam 108 during the transition.

In one embodiment, the electron beam 108 is focused to a first focal spot position 120 on anode 110 by applying a bias voltage 114 to a first electrode 112 and by applying a second bias voltage 118 to a second electrode 116 where the second bias voltage 118 is less than the first bias voltage 114. In another embodiment, magnets are placed in close proximity to the electron beam 108 in place of or in conjunction with biasing the electrodes 112, 116 to focus the electron beam 108 to first position 120 on the anode 110.

In another embodiment, the electron beam 108 is defocused prior to transitioning to a second position 122 on an anode 110 using electrostatic means by increasing the second bias voltage 118 on the second electrode 116. Increasing the second bias voltage 118 such that it approximates the first bias voltage 114 causes electron beam 108 to spread out across the transition area thereby reducing the flux density and the peak temperature of any particular spot in the transition area on the anode 110.

In another embodiment, the electron beam 108 is defocused by applying a magnetic field near the electron beam 108 where the magnetic poles spread the electron beam causing a reduction in flux density for any particular spot in the impact area on the anode 110.

In another embodiment, the electron beam 108 is refocused to a second position 122 on an anode 110 by decreasing a first bias voltage 114 on a first electrode 112 to a voltage less than a second bias voltage 118 on a second electrode 116. The differential in voltages will cause the electron beam 108 to move in the +x direction and focus on the second position 122 on the anode where the second position is located on a nominal focal spot radius 124 on the anode 110. In another embodiment, magnetic fields are used to move the electron beam 108 in the +x direction and to focus it on the second position 122.

In another embodiment, a method for reducing X-ray tube power de-rating during dynamic focal spot deflecting comprising generating an electron beam in a rotating anode X-ray tube 402, then focusing the electron beam to a first position 120 on an anode 404, then at least partially inhibiting the electron beam 602 and refocusing the electron beam 108 at a second position 122 on the anode 408.

In another embodiment, the electron beam is inhibited by applying a reverse bias to at least one electrode 112, 116, 126, 128 that is sufficiently strong to deflect the electron beam 108 and prevent it from impacting the surface of the anode 110 during the transition from a first position 120 and a second position 122 on the anode 110. The temperature of the anode decreases because the electron beam is prevented from impacting the anode.

In another embodiment, the electron beam is inhibited by applying a reverse bias to a dedicated beam suppression electrode (not shown) which is sufficiently strong to suppress the electron beam 108 and prevent it at least partially from impacting the surface of the anode 110 during the transition from a first position 120 and a second position 122 on the anode 110. The temperature of the anode decreases because some or all of the electron beam is prevented from impacting the anode.

In another embodiment, a method for reducing X-ray tube power de-rating during dynamic focal spot deflecting comprising generating an electron beam in a rotating anode X-ray tube 402, then focusing the electron beam to a first position on the anode 404, then steering the electron beam away from a nominal focal spot radius on the anode 702 and then refocusing the electron beam at a second position on the anode 408. The steering can be accomplished using electrostatic or magnetostatic means. Typically the electron beam would be steered to a larger focal spot radius where the impact temperature is reduced inversely proportional to the focal spot radius. The beam would then be advanced in +x direction to the new x-location. Finally the focal spot would be refocused at the second position by moving the electron beam radially to the nominal focal spot radius.

In yet another embodiment, the electron beam 108 is steered away from the nominal focal spot area 124 during the transition from a first position 120 on an anode 110 and a second position 122 on an anode 110 by biasing one or more electrodes 112, 116, 126, 128 to deflect and/or defocus the electron beam 108 out of the first position 120 on the anode 110. The electron beam can be steered in the +x or −x direction using electrodes 112, 116 such that the beam impact area is outside the nominal focal spot radius 124 on the anode or the beam may be steered to a different radius on the anode using electrodes 126, 128. The electron beam can be steering to practically any area on the anode 108 using different electrodes and biases to attract and deflect the electron beam 108.

After the electron beam 108 is moved outside the nominal focal spot radius 124 on the anode 110, the temperature on the impact area at the first position 120 decreases rapidly. As the beam deflected in the +x direction to its second position 122 and refocused on the second position 122 for oversampling, the anode 110 begins to heat up again but the maximum temperature of any spot in the nominal focal spot has been decreased.

In yet another embodiment, the electron beam is steered using magnetic fields.

Figure 8:
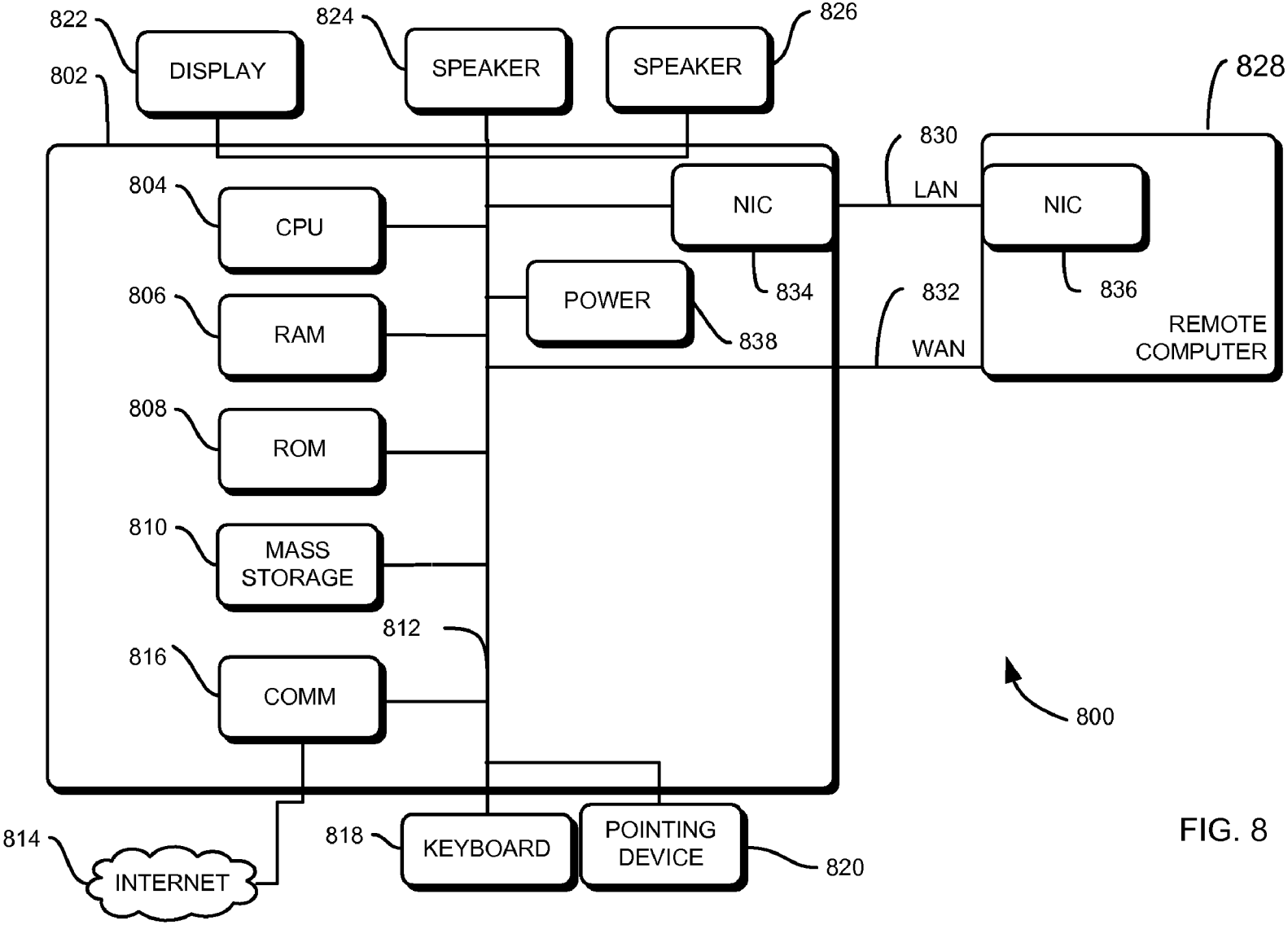
FIG. 8 is a block diagram of the hardware and operating environment in which different embodiments can be practiced.

FIG. 8 is a block diagram of the hardware and operating environment 800 in which different embodiments can be practiced. Through beam steering, inhibiting or defocusing the beam during the transition, the additional heating cycle is minimized as the electron beam 108 is refocused on the second position 112 on the anode 110. The reduction in anode temperature achieved through the precise manipulation of the electron beam during the transition from the first position 120 to the second position 122 allows the use of higher tube power without requiring the X-ray tube power de-rating to stay within the manufacturers maximum ratings.

In some embodiments, methods 400, 600-700 are implemented as a computer data signal embodied in a carrier wave, that represents a sequence of instructions which, when executed by a processor, such as processor 404 in FIG. 8, cause the processor to perform the respective method. In other embodiments, methods 400, 600-700 are implemented as a computer-accessible medium having executable instructions capable of directing a processor, such as processor 804 in FIG. 8, to perform the respective method. In varying embodiments, the medium is a magnetic medium, an electronic medium, or an optical medium.

Hardware and Operating Environment

FIG. 8 is a block diagram of the hardware and operating environment 800 in which different embodiments can be practiced. The description of FIG. 8 provides an overview of computer hardware and a suitable computing environment in conjunction with which some embodiments can be implemented. Embodiments are described in terms of a computer executing computer-executable instructions. However, some embodiments can be implemented entirely in computer hardware in which the computer-executable instructions are implemented in read-only memory. Some embodiments can also be implemented in client/server computing environments where remote devices that perform tasks are linked through a communications network. Program modules can be located in both local and remote memory storage devices in a distributed computing environment.

Computer 802 includes a processor 804, commercially available from Intel, Motorola, Cyrix and others. Computer 802 also includes random-access memory (RAM) 806, read-only memory (ROM) 808, and one or more mass storage devices 810, and a system bus 812, that operatively couples various system components to the processing unit 804. The memory 806, 808, and mass storage devices, 810, are types of computer-accessible media. Mass storage devices 810 are more specifically types of nonvolatile computer-accessible media and can include one or more hard disk drives, floppy disk drives, optical disk drives, and tape cartridge drives. The processor 804 executes computer programs stored on the computer-accessible media.

Computer 802 can be communicatively connected to the Internet 814 via a communication device 816. Internet 814 connectivity is well known within the art. In one embodiment, a communication device 816 is a modem that responds to communication drivers to connect to the Internet via what is known in the art as a "dial-up connection." In another embodiment, a communication device 816 is an Ethernet® or similar hardware network card connected to a local-area network (LAN) that itself is connected to the Internet via what is known in the art as a "direct connection" (e.g., T1 line, etc.).

A user enters commands and information into the computer 802 through input devices such as a keyboard 818 or a pointing device 820. The keyboard 818 permits entry of textual information into computer 802, as known within the art, and embodiments are not limited to any particular type of keyboard. Pointing device 820 permits the control of the screen pointer provided by a graphical user interface (GUI) of operating systems such as versions of Microsoft Windows®. Embodiments are not limited to any particular pointing device 820. Such pointing devices include mice, touch pads, trackballs, remote controls and point sticks. Other input devices (not shown) can include a microphone, joystick, game pad, satellite dish, scanner, or the like.

In some embodiments, computer 802 is operatively coupled to a display device 822. Display device 822 is connected to the system bus 812. Display device 822 permits the display of information, including computer, video and other information, for viewing by a user of the computer. Embodiments are not limited to any particular display device 822. Such display devices include cathode ray tube (CRT) displays (monitors), as well as flat panel displays such as liquid crystal displays (LCD's). In addition to a monitor, computers typically include other peripheral input/output devices such as printers (not shown). Speakers 824 and 826 provide audio output of signals. Speakers 824 and 826 are also connected to the system bus 812.

Computer 802 also includes an operating system (not shown) that is stored on the computer-accessible media RAM 806, ROM 808, and mass storage device 810, and is and executed by the processor 804. Examples of operating systems include Microsoft Windows®, Apple MacOS®, Linux®, UNIX®. Examples are not limited to any particular operating system, however, and the construction and use of such operating systems are well known within the art.

Embodiments of computer 802 are not limited to any type of computer 802. In varying embodiments, computer 802 comprises a PC-compatible computer, a MacOS®-compatible computer, a Linux®-compatible computer, or a UNIX®-compatible computer. The construction and operation of such computers are well known within the art.

Computer 802 can be operated using at least one operating system to provide a graphical user interface (GUI) including a user-controllable pointer. Computer 802 can have at least one web browser application program executing within at least one operating system, to permit users of computer 802 to access intranet or Internet world-wide-web pages as addressed by Universal Resource Locator (URL) addresses. Examples of browser application programs include Netscape Navigator® and Microsoft Internet Explorer®.

The computer 802 can operate in a networked environment using logical connections to one or more remote computers, such as remote computer 828. These logical connections are achieved by a communication device coupled to, or a part of, the computer 802. Embodiments are not limited to a particular type of communications device. The remote computer 828 can be another computer, a server, a router, a network PC, a client, a peer device or other common network node. The logical connections depicted in FIG. 8 include a local-area network (LAN) 830 and a wide-area network (WAN) 832. Such networking environments are commonplace in offices, enterprise-wide computer networks, intranets and the Internet.

When used in a LAN-networking environment, the computer 802 and remote computer 828 are connected to the local network 830 through network interfaces or adapters 834, which is one type of communications device 816. Remote computer 828 also includes a network device 836. When used in a conventional WAN-networking environment, the computer 802 and remote computer 828 communicate with a WAN 832 through modems (not shown). The modem, which can be internal or external, is connected to the system bus 812. In a networked environment, program modules depicted relative to the computer 802, or portions thereof, can be stored in the remote computer 828.

Computer 802 also includes power supply 838. Each power supply can be a battery.

CONCLUSION

A method for reducing X-ray tube power de-rating during dynamic focal spot deflection is described. Although specific embodiments are illustrated and described herein, it will be appreciated by those of ordinary skill in the art that any arrangement which is calculated to achieve the same purpose may be substituted for the specific embodiments shown. This application is intended to cover any adaptations or variations. For example, although described as pertaining to X-ray tubes used in CT systems, one of ordinary skill in the art will appreciate that implementations can be made in any usage where X-ray generation is desired or any other X-ray system that provides the required function.

In particular, one of skill in the art will readily appreciate that the names of the methods and apparatus are not intended to limit embodiments. Furthermore, additional methods and apparatus can be added to the components, functions can be rearranged among the components, and new components to correspond to future enhancements and physical devices used in embodiments can be introduced without departing from the scope of embodiments. One of skill in the art will readily recognize that embodiments are applicable to different manners of producing an electron beam. Also, although the generation of the electron beam is described as boiling electrons off a heated filament, any form of electron gun may be substituted and still provide the required function. Also, although an X-ray tube with four electrodes is described, the method may be practiced with at least two electrodes.

I claim:

1. A method for reducing X-ray tube power de-rating during dynamic focal spot deflection comprising:

generating an electron beam in a rotating anode X-ray tube;

in response to the generating the beam, focusing the electron beam to a first position on the anode;

in response to the focusing, defocusing the electron beam on the anode; and in response to the defocusing, refocusing the electron beam at a second position on the anode, wherein the first position on the anode is a different position than the second position on the anode.

2. The method of claim 1 wherein focusing the electron beam to a first position further comprises:

biasing a first electrode with a first bias voltage; and biasing a second electrode with a second bias voltage where the second bias voltage is less than the first bias voltage to direct the electron beam to a first position located on a nominal focal spot radius on the anode.

3. The method of claim 2 wherein focusing the electron beam to a first position further comprises:

biasing a third electrode with a third bias voltage; and biasing a fourth electrode with a fourth bias voltage where the fourth bias voltage is less than the third bias voltage to direct the electron beam to the first position located on the nominal focal spot radius on the anode.

4. The method of claim 1 wherein defocusing the electron beam further comprises:

increasing a bias voltage on a second electrode in comparison to a first electrode.

5. The method of claim 4 wherein defocusing the electron beam further comprises:

increasing a bias voltage on a fourth electrode in comparison to a third electrode.

6. The method of claim 1 wherein refocusing the electron beam at a second position on the anode further comprises:

decreasing a first bias voltage on a first electrode to a voltage less than a second bias voltage on a second electrode to direct and focus the electron beam to a second position located on a nominal focal spot radius on the anode.

7. The method of claim 6 wherein refocusing the electron beam at a second position on the anode further comprises:

decreasing a third bias voltage on a third electrode to a voltage less than a fourth bias voltage on a fourth electrode to direct and focus the electron beam to the second position located on a nominal focal spot radius on the anode.

8. The method of claim 1 wherein focusing the electron beam to a first position further comprises:

applying one or more magnetic field.

9. The method of claim 1 wherein defocusing the electron beam further comprises:

applying one or more magnetic field.

10. The method of claim 1 wherein refocusing the electron beam at a second position on the anode further comprises:

applying one or more magnetic fields to refocus the electron beam at the second position on the anode.

11. A method for reducing X-ray tube power de-rating during dynamic focal spot deflection comprising:

generating an electron beam in a rotating anode X-ray tube;

in response to the generating the beam, focusing the electron beam to a first position on the anode; and in response to the focusing, refocusing the electron beam at a second position on the anode, wherein the first position on the anode is a different position than the second position on the anode.

12. The method of claim 11 wherein focusing the electron beam to a first position further comprises:

biasing a first electrode with a first bias voltage; and biasing a second electrode with a second bias voltage where the second bias voltage is less than the first bias voltage to direct the electron beam to a first position located on a nominal focal spot radius on the anode.

13. The method of claim 11 wherein the method further comprises:

biasing one or more electrodes to deflect the electron beam out of a nominal focal spot radius on the anode.

14. The method of claim 11 wherein refocusing the electron beam at a second position on the anode further comprises:

biasing a first electrode with a first bias voltage; and biasing a second electrode with a second bias voltage where the second bias voltage is greater than the first bias voltage to direct the electron beam to a second position located on a nominal focal spot radius on the anode.

15. The method of claim 11 wherein focusing the electron beam to a first position further comprises:

applying one or more magnetic fields to direct the electron beam to a first position.

16. The method of claim 11 wherein the method further comprises:

applying one or more magnetic field to deflect the electron beam out of the nominal focal spot radius on the anode.

17. The method of claim 11 wherein refocusing the electron beam at a second position on the anode further comprises:

applying one or more magnetic fields to refocus the electron beam at the second position on the anode.

* * * * *